United States Patent [19]

Reuge

[11] 3,967,755

[45] July 6, 1976

[54] PRESENTATION DEVICE WITH A MUSICAL MOVEMENT

[76] Inventor: Guido Reuge, 21, rue des Rasses, 1450 Ste Croix, Switzerland

[22] Filed: Sept. 9, 1975

[21] Appl. No.: 611,603

[30] Foreign Application Priority Data

Sept. 10, 1974 Switzerland ..... 12324/74

[52] U.S. Cl. ..... 221/3

[51] Int. Cl.[2] ..... G10F 1/06

[58] Field of Search ..... 221/3; 222/39; 84/95, 84/96, 97; 206/249, 250, 264

[56] References Cited

UNITED STATES PATENTS

| | | | |
|---|---|---|---|
| 243,781 | 7/1881 | Koch | 84/95 C |
| 2,501,861 | 3/1950 | Braun | 84/95 C |

*Primary Examiner*—Stanley H. Tollberg

*Attorney, Agent, or Firm*—Wenderoth, Lind & Ponack

[57] ABSTRACT

The invention is directed to a presentation device provided with a musical movement for articles, particularly cigarettes or the like, said device comprising at least one holder for the articles to be presented, said holder being mounted pivotally on a spindle so as to move from a closed position to an open position where the articles to be presented are visible, the pivot-spindle of the holder carrying a pinion engaging with a ring-gear driven by at least one angle-lever mounted on the ring-gear and actuated by a crank fixed to the spindle of the drum of the musical movement, wherein two angle-levers are pivoted on the ring-gear, and a return-spring maintains said levers near to each other while permitting a relative movement therebetween.

1 Claim, 2 Drawing Figures

Fig. 1
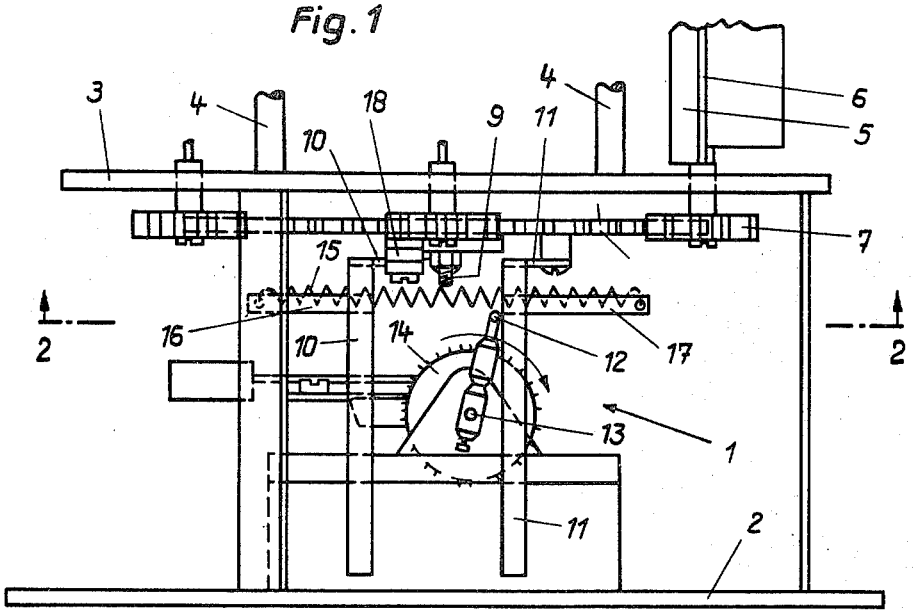
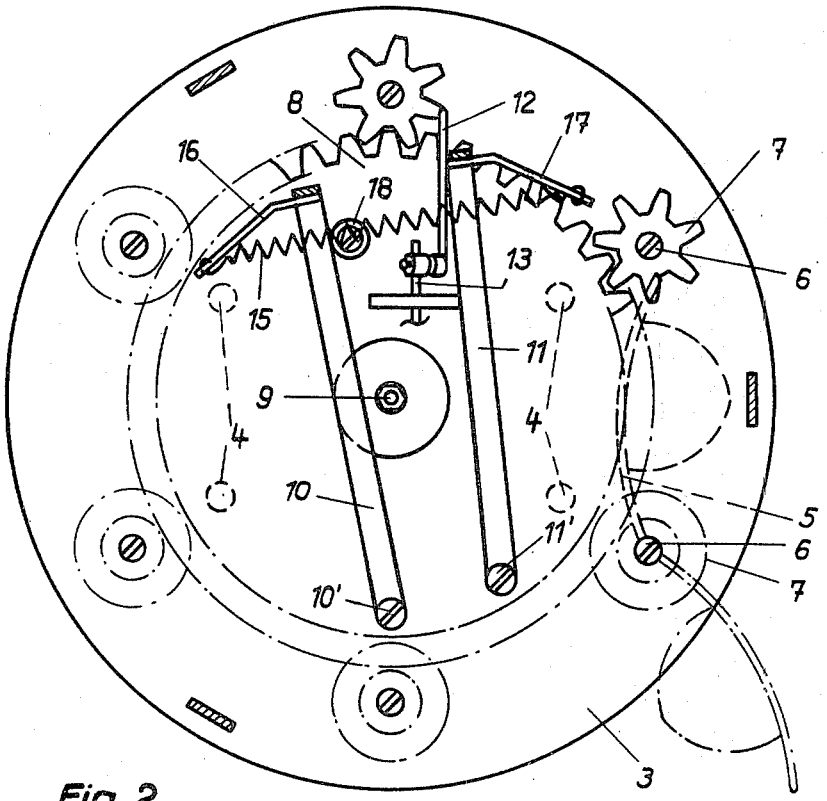
Fig. 2

PRESENTATION DEVICE WITH A MUSICAL MOVEMENT

This invention is directed to a presentation device provided with a musical movement for articles, particularly cigarettes or the like, said device, comprising at least one holder for the articles to be presented, said holder being pivotally mounted on spindle so as to move from a closed position to an opened position where the articles to be presented are visible, the pivoting spindle of the holder carrying a pinion engaging with a ring-gear driven by at least one angle-lever mounted on the ring-gear and actuated by a crank fixed to the axle of the drum of the musical movement, said drum being provided with pins in the known manner.

Known presentation devices of this kind comprise a series of pivotable doors or panels constituting holders for the articles to be presented and mounted between two horizontal plates.

These plates are connected to each other with columns or the like and constitute the housing of the presentation device. The upper plate is covered by a cupola or other decorative element. The panels in the closed position form a decorative surface of a generally cylindrical shape and in the open position they present the articles to the view of the user.

In said known presentation devices, the control of the opening and closing of the panels is effected rigidly by means of a fork actuating the ring-gear from the crank of the musical movement, said crank engaging between the arms of the fork. This arrangement has the inconvenience of using a rigid fork which can be deformed and can damage the mechanism when the user pushes or holds back one of the panels with his hand.

It has already been proposed that the rigid fork be replaced by a spindle and a return-spring, but this arrangement protects the mechanism in one direction only.

The present invention aims at overcoming these disadvantages by providing a presentation device wherein two angle-levers are pivoted on the ring-gear, and a return-spring maintains said levers near to each other while permitting a relative movement there between.

The accompanying drawing illustrates an embodiment of the device of this invention.

FIG. 1 is a part of a vertical view of a detail of said embodiment.

FIG. 2 is a cross-section view along the line 2—2 of FIG. 1.

The presentation device partially shown comprises a musical movement generally indicatd at 1 mounted on a base plate 2 and enclosed in a housing provided with two horizontal plates, only the lower plate 3 being shown. Said plates are connected to each other by the columns 4.

Article holders are pivotally mounted between said two plates, only one of said holders being shown at 5.

Said article holder 5 is fixed to a vertical spindle 6 so as to pass from a closed position (shown by dotted line) to an open position (shown by a continuous line) where the articles to be presented are visible. The pivot spindle 6 carries a pinion 7 engaging a ring-rear 8 mounted on a spindle 9 fixed to the centre of the lower plate 3. The ring-gear 8 is driven by two angle-levers 10, 11 pivoted at 10′, 11′ respectively on said ring-gear. For this purpose, a crank 12 is fixed to the shaft 13 of the drum provided with pins 14 of the musical movement 1, said crank acting by means of its arm on the angled portions of the levers 10 and 11. A return-spring 15 is fixed at each end on the arms 16, 17 respectively integral with each of the angled portions of the levers 10 and 11.

The spring 15 maintains the two levers 10 and 11 near together and against an abutment 18 while permitting a relative displacement therebetween.

The operation of the above described presentation device is as follows:

When the musical movement is working, the crank 12 is driven in the direction of the arrow by the shaft 13 of the drum 14 and bears against the lever 11 which is moved aside against the force of the spring 15. The lever 10 is then elastically applied against the abutment 18, thus causing the ring-gear 8 to be driven in a rotary motion. The pinions 7 engaging with said ring-gear 8 are then driven and each pinion causes the pivoting of the spindle on which the article holder 5 is fixed. The ring-gear 8 can be locked without damaging the driving mechanism. Indeed, by retaining the article holder 5 in the open or closed position, the ring-gear 8 is locked but the crank 12 continues to drive the corresponding angled portion of one of the levers 10 or 11 against the force of the spring 15, whereby the other lever remains locked against the fixed abutment 18.

Instead of having a set of article holders disposed around a cylindrical surface, the same actuating mechanism could be used for any other presenting device, particularly for a "tryptic" having two doors which open to present the articles.

What is claimed is:

1. A presentation device provided with a musical movement for articles, particularly cigarettes or the like, said device comprising at least one holder for the articles to be presented, said holder being mounted pivotally on a spindle so as to move from a closed position to an open position where the articles to be presented are visible, the pivot-spindle of the holder carrying a pinion engaging with a ring-gear driven by at least one angle-lever mounted on the ring-gear and actuated by a crank fixed to the spindle of the drum of the musical movement, wherein two angle-levers are pivoted on the ring-gear, and a return-spring maintains said levers near to each other while permitting a relative movement therebetween.

* * * * *